US005531140A

United States Patent [19]

Chow

[11] Patent Number: 5,531,140

[45] Date of Patent: Jul. 2, 1996

[54] COUPLING MECHANISM OF SOCKET WRENCH EXTENSION

[76] Inventor: Jessie Chow, No. 18, Hou Juan Road, Taichung, Taiwan

[21] Appl. No.: 489,924

[22] Filed: Jun. 12, 1995

[51] Int. Cl.[6] ..... B25B 13/00

[52] U.S. Cl. ..... 81/177.85; 403/325; 403/328

[58] Field of Search ..... 81/177.85; 403/322, 403/324, 325, 328; 279/79

[56] References Cited

U.S. PATENT DOCUMENTS 4,614,457 9/1986 Sammon ..... 403/328 X
4,740,122 4/1988 Glaser ..... 403/324 X
4,781,085 11/1988 Fox .
4,962,682 10/1990 Rose et al. .
5,390,571 2/1995 Fox, III et al. ..... 81/177.85

*Primary Examiner*—James G. Smith
*Attorney, Agent, or Firm*—Charles E. Baxley

[57] ABSTRACT

A socket wrench extension includes an axial bore for receiving a rod and includes an opening and an orifice for receiving a ball and an actuator. The actuator includes a tapered surface for moving the rod inward of the axial bore. The rod includes an aperture for engaging with the actuator and a cavity for receiving the ball. A spring biases the rod to move the ball partially outward of the opening so as to engage with a socket member. The ball is received in the cavity when the rod is moved inward by the actuator. The elements may be easily assembled in the extension.

2 Claims, 2 Drawing Sheets

COUPLING MECHANISM OF SOCKET WRENCH EXTENSION

BACKGROUND OF THE INVENTION

1. Field of the Invention

The present invention relates to a coupling mechanism, and more particularly to a coupling mechanism of a socket wrench extension.

2. Description of the Prior Art

A typical locking socket wrench extension is disclosed in U.S. Pat. No. 4,781,085 to Fox, III and comprises a locking bolt slidably engaged in the axial bore of the extension, a thumb lever for moving the locking bolt and a ball actuated by the locking bolt to engage with the sockets. Both the thumb lever and the locking bolt comprise a rather complicated configuration that is not good for manufacturing purposes. In addition, a cover is required to be secured to the end portion of the axial bore for preventing the ball from disengaging from the extension. However, it will be difficult to secure the cover in place.

Another typical wrench extension and socket coupler is disclosed in U.S. Pat. No. 4,962,682 to Rose et al., and comprises a longitudinal passageway for receiving a number of balls and a lateral passageway for receiving an actuator and a spring therein. The balls and the actuator may not easily assembled in the extension. The actuator should be depressed inward of the lateral passageway by a post means before the opening of the lateral passageway is formed with an annular crimp for retaining the actuator in place. It will be difficult to depress the actuator and to form the annular crimp simultaneously.

The present invention has arisen to mitigate and/or obviate the afore-described disadvantages of the conventional socket wrench extensions.

SUMMARY OF THE INVENTION

The primary objective of the present invention is to provide a coupling mechanism of a socket wrench extension which can be easily assembled.

In accordance with one aspect of the invention, there is provided a socket wrench extension comprising a body including an axial bore formed therein, and including an opening and an orifice formed therein and intersecting with the axial bore, the axial including an open end, a ball engaged in the opening, an actuator engaged in the orifice and including a lower portion having a lateral projection and a first tapered surface formed therein, a rod slidably engaged in the axial bore of the body and including an aperture formed therein for engaging with the lower portion of the actuator and including a recess in communication with the aperture for receiving the lateral projection of the actuator, the rod including a cavity for receiving the ball and including a second tapered surface for engaging with the ball and for moving the ball partially outward of the opening, and means for biasing the rod to engage with the first tapered surface of the actuator and for engaging the projection of the actuator in the recess of the rod, and the biasing means biasing the second tapered surface of the rod to engage with the ball so as to move the ball partially outward of the opening. The rod is moved inward of the axial bore of the body against the biasing means by the first tapered surface of the actuator when the actuator is depressed inwards of the orifice, such that the ball is received in the cavity of the rod. The rod includes an end cap for enclosing the axial bore of the body. The coupling mechanism includes a configuration that is excellent for assembling purposes.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
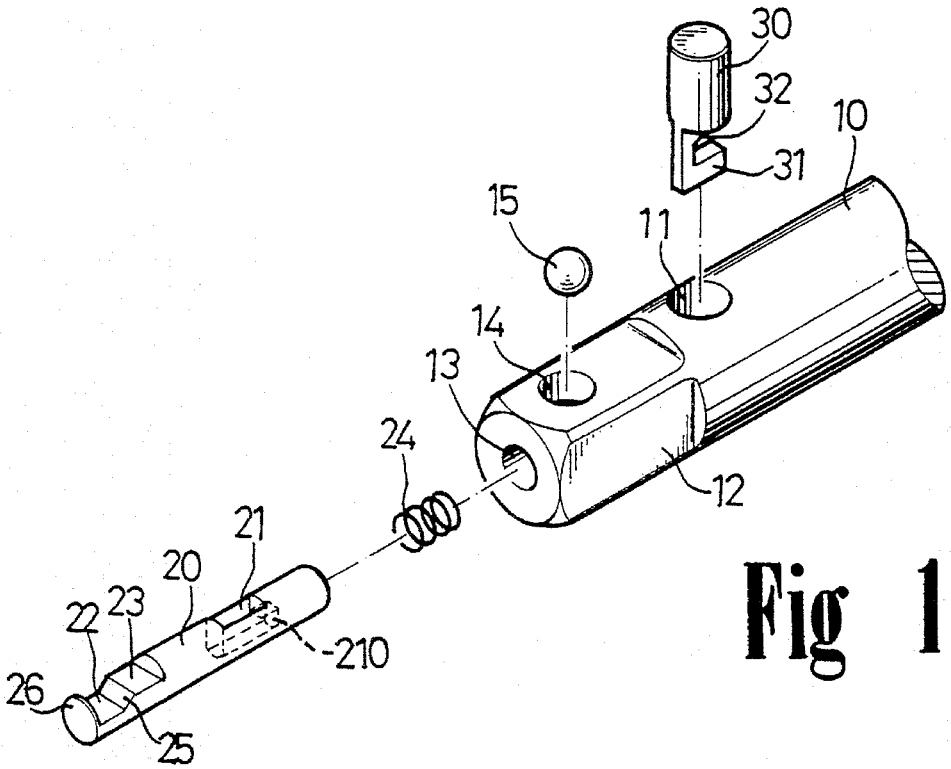
FIG. 1 is a partial exploded view of a socket wrench extension in accordance with the present invention.
Figure 2:
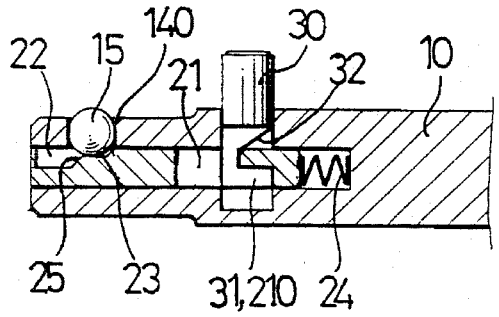
FIGS. 2 and 3 are cross sectional views taken along lines 2—2 of FIG. 4.
Figure 4:
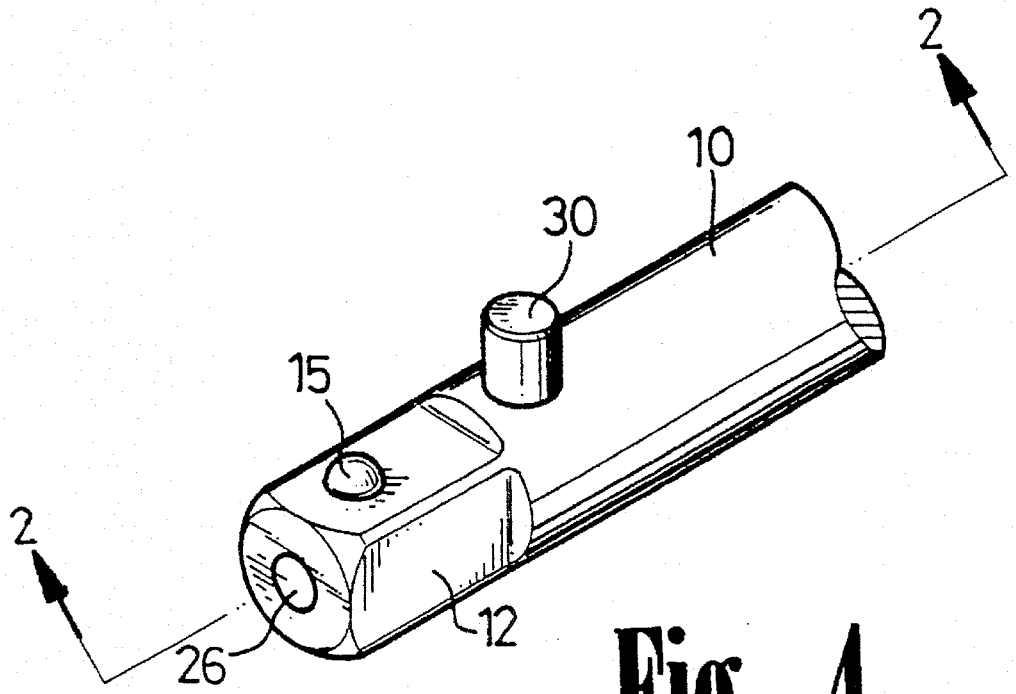
FIG. 4 is a partial perspective view of the socket wrench extension.

Referring to the drawings, and initially to FIGS. 1, 2 and 4, a socket wrench extension in accordance with the present invention comprises a body 10 including an axial bore 13 formed in one end portion 12 thereof for receiving a spring 24 and a rod 20 therein, and including an opening 14 and an orifice 11 formed therein and intersecting with the axial bore 13 for receiving a ball 15 and an actuator 30 respectively. The actuator 30 includes a lateral projection 31 and a tapered surface 32 formed in the bottom portion. The rod 20 includes an aperture 21 formed therein for engaging with the lower portion of the actuator 30 and includes a recess 210 communicating with the aperture 21 so as to form an L-shaped engaging means and for engaging with the projection 31 of the actuator 30. The rod 20 includes a cavity 22 and a depression 23 formed therein for engaging with the ball 15 and includes a tapered surface 25 formed between the cavity 22 and the depression 23 for actuating the ball 15. The rod 20 further includes an end cap 26 for retaining the ball 15 within the cavity 22 and for enclosing the axial bore 13 of the extension body 10, best shown in FIG. 4.

It is to be noted that the opening 14 includes an upper portion having an annular crimp 140 of reduced diameter formed therein for engaging with the ball 15 and for retaining the ball 15 within the opening 14. The annular crimp 140 permits only a portion of the ball 15 to protrude from the opening 14 in order to engage with socket members. The tapered surface 32 of the actuator 30 is engaged with the rod 20 for moving the rod 20 against the spring 24 so as to engage the ball 15 within the cavity 22 of the rod 20.

Figure 3:
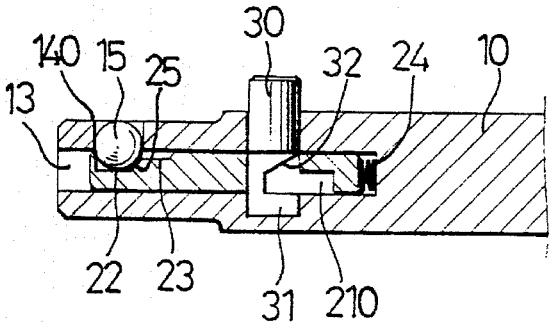

In assembling the coupling mechanism of the socket wrench extension, as shown in FIGS. 2 and 3, it is only required to engage the spring 24 and the rod 20 inward of the axial bore 13 of the body 10 and engage the lower portion of the actuator 30 into the aperture 21 of the rod 20. The rod 20, the spring 24 and the actuator 30 may thus be solidly secured within the end portion 12 of the extension body 10. When the rod 20 is moved against the spring 24, the ball 15 may be engaged into the opening 14. The annular crimp 140 is then formed for retaining the ball 15 within the opening 14. The parts may be easily assembled within the body 10. It is to be noted that the actuator 30 for moving the rod 20 inward of the axial bore 13 is separated from the ball 15 such that the ball 15 can be easily received in the cavity 22 and such that the annular crimp 140 can be easily formed.

In operation, as shown in FIG. 2, the ball 15 is moved partially outward of the opening 14 by the tapered surface 25 of the rod 20 when the rod 20 is biased by the spring 24 such that the ball 15 may be engaged with the socket members. At this moment, the rod 20 is engaged with the tapered surface 32 of the actuator 30 for moving the actuator 30 partially outward of the body 10. However, as shown in FIG. 3, the rod 20 can be moved inward of the axial bore 13 of the body 10 against the spring 24 by the tapered surface 32 of the actuator 30 so as to engage the ball 15 within the cavity 22 of the rod 20 such that the ball 15 can be disengaged from the socket members. The axial bore 13 can be easily enclosed by the end cap 26 of the rod 20 which may prevent dirt from entering into the axial bore 13.

Accordingly, the coupling mechanism of the socket wrench extension in accordance with the present invention includes a configuration that is excellent for assembling purposes.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A socket wrench extension comprising:

a body including an axial bore formed therein, and including an opening and an orifice formed therein and intersecting with said axial bore, said axial bore including an open end, a ball engaged in said opening, an actuator engaged in said orifice and including a lower portion having a lateral projection and a first tapered surface formed therein, a rod slidably engaged in said axial bore of said body and including an aperture formed therein for engaging with said lower portion of said actuator and including a recess in communication with said aperture for receiving said lateral projection of said actuator, said rod including a cavity for receiving said ball and including a second tapered surface for engaging with said ball and for moving said ball partially outward of said opening, and means for biasing said rod to engage with said first tapered surface of said actuator and for engaging said projection of said actuator in said recess of said rod, and said biasing means biasing said second tapered surface of said rod to engage with said ball so as to move said ball partially outward of said opening, said rod being moved inward of said axial bore of said body against said biasing means by said first tapered surface of said actuator when said actuator is depressed inwards of said orifice, such that said ball is received in said cavity of said rod.

2. A socket wrench extension according to claim 1, wherein said rod includes an end cap for enclosing said axial bore of said body.

* * * * *